US007669529B2

(12) United States Patent
Cummings et al.

(10) Patent No.: US 7,669,529 B2
(45) Date of Patent: Mar. 2, 2010

(54) APPARATUS FOR MOUNTING AND DISMOUNTING SHEET MATERIAL TO AND FROM A DRUM

(75) Inventors: Calvin D. Cummings, Surrey (CA); Lon W. McIlwraith, Delta (CA)

(73) Assignee: Eastman Kodak Company, Rochester, NY (US)

( * ) Notice: Subject to any disclaimer, the term of this patent is extended or adjusted under 35 U.S.C. 154(b) by 48 days.

(21) Appl. No.: 11/956,607

(22) Filed: Dec. 14, 2007

(65) Prior Publication Data

US 2009/0151580 A1 Jun. 18, 2009

(51) Int. Cl.
*B41F 27/12* (2006.01)

(52) U.S. Cl. ..... 101/415.1; 101/409; 101/477; 271/277

(58) Field of Classification Search ..... 101/477, 101/409, 410, 415.1; 271/82, 277
See application file for complete search history.

(56) References Cited

U.S. PATENT DOCUMENTS 6,260,482 B1 * 7/2001 Halup et al. ..... 101/477
6,752,080 B2 * 6/2004 Fukui ..... 101/415.1
2001/0032561 A1 10/2001 Halup et al.
2003/0037688 A1 * 2/2003 Fukui ..... 101/477
2003/0051621 A1 3/2003 Fukui
2005/0193913 A1 9/2005 Toledo

FOREIGN PATENT DOCUMENTS

EP 1 364 779 A2 11/2003

* cited by examiner

*Primary Examiner*—Leslie J Evanisko
(74) *Attorney, Agent, or Firm*—Nelson Adrian Blish

(57) ABSTRACT

An apparatus for mounting and demounting a materials sheet onto and from a cylindrical surface of a drum (10) has clamps (40) pivotably arranged upon the sheet materials drum. The clamps have a first region (80) and a second region (70) either side of a pivot axis. The second region (70) clamps the materials sheet to the cylindrical surface (20) of the drum. A backbone (120) extends along the length of the drum and is removably attached to the drum. Push rods (90) movably arranged on the backbone are capable of being operated to push against the first region of the clamps to pivot the clamps to move the second region of the clamps. Any existing clasped materials sheet is thereby unclasped from the cylindrical surface.

4 Claims, 9 Drawing Sheets

APPARATUS FOR MOUNTING AND DISMOUNTING SHEET MATERIAL TO AND FROM A DRUM

FIELD OF THE INVENTION

The invention relates to methods and apparatuses for loading sheet materials on drums such as those employed in plate-setting machines in the printing industry.

BACKGROUND OF THE INVENTION

In the printing industry, the inclusion of a computer-to-plate (CTP) system in a printing operation suggests a great extent of automation. A full CTP process can automate, through the use of computers and special equipment, the transfer of information from the original layout to the press plate. A computer-to-plate (CTP) system accepts input jobs/pages written in a page description language, for example, Postscript, and the jobs are sent through a raster image processor to a platemaker for exposure. The platemaker engine images the raster data on a plate, which is later mounted on a press, inked and made ready for printing.

Also included in the automation of a CTP system is the media handling. It is necessary to supply plates individually from a plate supply area to the platemaker engine and it is desirable to reduce the amount of operator handling involved. Unexposed plates are normally supplied in packages of 10 to 100 plates, with interleaf paper-sheets between the plates for protecting the emulsion side of the plates, which is extremely sensitive to scratches. The stack of plates is loaded into a supply area of a platemaker in a manner that keeps the stack of plates aligned with automation mechanisms for removing a plate from the stack, and for discarding the interleaf sheets from the stack.

While smaller plates can be loaded by hand, the advent of large printing plates has necessitated the automatic loading of plates onto the sheet materials drum or imaging drum of the CTP platesetter apparatus. While medium-sized platemaking machines with imaging drums of a few feet in length are common-place and printing plates are comparatively easy to load onto or unload from such machines, the same cannot be said for larger machines. The printing industry requires placement of plates with great accuracy when moving over distances of a meter or more. Under pressure from the printing industry for ever greater throughput, the latest generation of extra large format platemaking machines being developed at this time has imaging drums of more than 3 meters in length. At the same time there is no quarter to be sacrificed in quality and precision. It is therefore necessary to be able to load and unload extremely large and heavy materials sheets of the order of 3.15×1.60 meters in size automatically with great accuracy and precision.

One of the proven ways of securing a printing plate for imaging to an imaging drum is to employ spring loaded clamps to clamp the leading edge of the plate to the drum, to then wrap the plate around the drum and to then secure the trailing edge of the plate. In view of the larger and heavier plates being employed, one of the mechanisms developed to automatically open the clamps is to have a push rod, movably attached to a backbone that typically runs the length of the drum, that is moved down towards the clamp to push upon it in such a way as to compress the spring providing the clamping force, thereby opening the clamp and allowing the edge of the plate to be removed from the clamp.

While this was a relatively simple matter in the case of smaller machines, it becomes a rather more complex matter in systems with long imaging drums. In such large systems the sheer length of the backbone carrying the push rods, together with the greater pushing forces required to release large heavy plates from more substantial clamps, can cause the very backbone itself to flex in reaction. This complicates the loading and unloading of the printing plate involved. The same challenge translates to the presses used for printing with such large plates. Both kinds of machines have a drum, the platemaking machine and imaging drum and the press having a drum for mounting the plate imaged by a platemaking machine.

Thus, there remains a need for a simple, flexible and efficient method to load very large printing plates automatically with accuracy and precision onto a sheet materials drum for imaging, and to unload the imaged plates from the drum.

SUMMARY OF THE INVENTION

Briefly, according to one aspect of the present invention a method and apparatus provides for mounting and demounting a materials sheet onto and from a sheet materials drum such as those used in the printing industry. A drum has at least one clamp pivotably arranged upon it. The clamp has a first region and a second region, and the second region clamps the materials sheet to the cylindrical surface of the drum. The pivot axis of the clamp is between the first region and the second region of the clamp, allowing the second region to clamp the materials sheet to the cylindrical surface when the first region of the clamp rises and allowing the second region to release the materials sheet when the first region is depressed by a push rod. The push rod is mounted movably on a backbone that extends along the length of the sheet materials drum proximate the cylindrical surface. In order to prevent the backbone flexing and thereby impeding the mounting and demounting of the materials sheet, the backbone is removably attached to the sheet materials drum prior to the pushing by the push rod. The pushrod is then pushed against the second region of the clamp to thereby raise the first region. This makes it possible to either remove a materials sheet that was clasped by the second region of the clamp, or to position a materials sheet in that location. In the case of the latter, the second region of the clamp then clasps the materials sheet to the cylindrical surface when the push rod is operated to not push on the second region of the clamp.

In one embodiment of the present invention the removably attaching is accomplished by attaching the backbone to the sheet materials drum using a latching arrangement. The latching arrangement comprises a latch that is pivotably arranged on the backbone and which engages with a slot in the sheet materials drum. More specifically, a protrusion on the latch engages with a ledge of the slot. A plurality of clamps, push rods and latches may be arranged along the length of the backbone and sheet materials drum to thereby reduce flexing of the backbone and improve the handling of materials sheets. Before removably attaching the backbone to the sheet materials drum, the backbone can be positioned proximate the cylindrical surface of sheet materials drum. After detaching the backbone from the sheet materials drum, the backbone can be relocated away from the cylindrical surface of the sheet materials drum.

BRIEF DESCRIPTION OF THE DRAWINGS

In the drawings which illustrate non-limiting embodiments of the invention.

DETAILED DESCRIPTION OF THE INVENTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
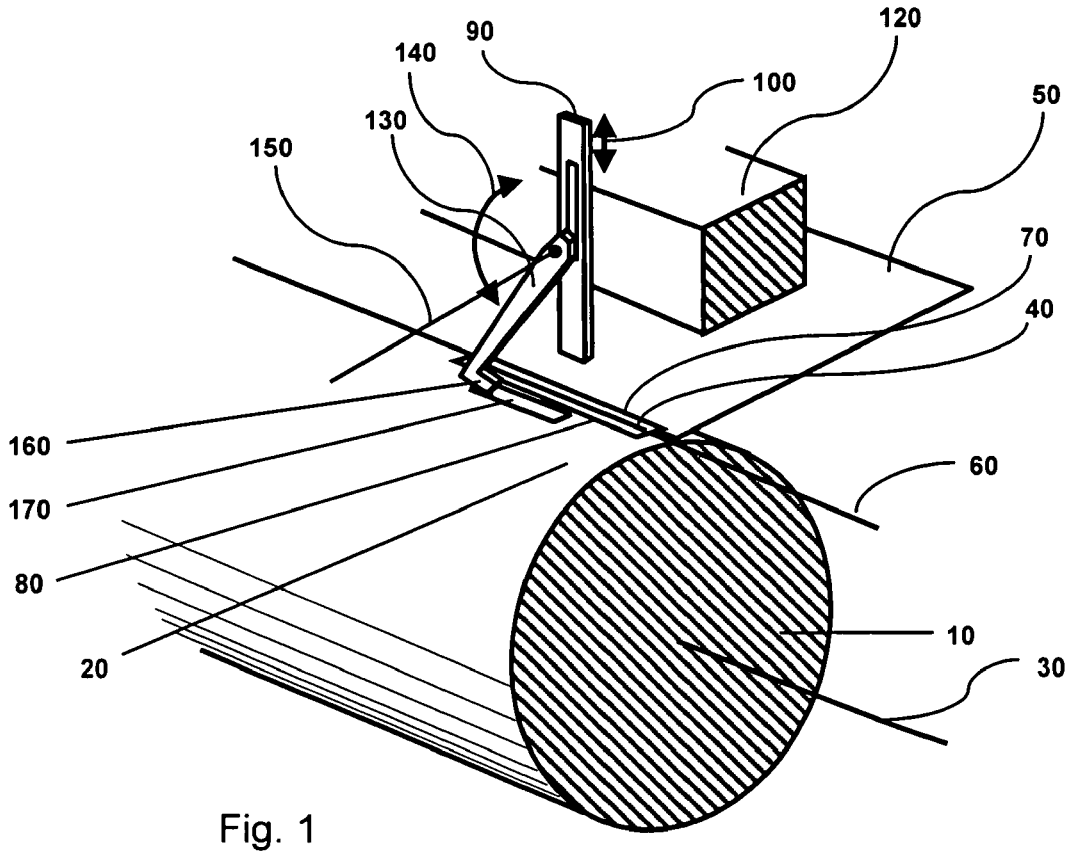
FIG. 1 shows a sheet materials drum with an latch, slot, clamp and pushrod arrangement for clamping a materials sheet to the cylindrical surface of the sheet materials drum.

FIG. 1 shows the apparatus of the present invention as a drum 10 having cylindrical surface 20. Drum 10 is arranged to be rotatable around cylindrical axis 30. The term "drum" is used to describe a drum in that is generally used for mounting sheet materials such as printing plates, as in the case of offset presses, or for mounting un-imaged lithographic precursor plates as in the case of platesetter machines.

At least one clamp 40 is arranged on cylindrical surface 20 of drum 10 to pivot about pivot axis 60, thereby to clamp the leading edge of materials sheet 50 by means of clamp proximal end 70. Pivot axis 60 and distal end 80 of clamp 40 can optionally be recessed below cylindrical surface 20 of drum 10. Proximal end 70 of clamp 40, however, is arranged to allow materials sheet 50 to be clamped to cylindrical surface 20 by clamp proximal end 70 and therefore proximal end 70 at least partially protrudes outside of cylindrical surface 20. In this arrangement clamp proximal end 70 rises with respect to drum 10 when clamp distal end 80 is depressed toward cylindrical axis 30. Conversely, clamp proximal end 70 closes down towards cylindrical surface 20 when clamp distal end 80 rises away from drum 10. Clamp distal end 80 is spring loaded (shown in more detail in FIG. 3, FIG. 4*a* and FIG. 4*b*) to ensure that, in its relaxed state, at least one clamp 40 assumes a closed state in which proximal end 70 will clamping down onto materials sheet 50, when materials sheet 50 is present. In FIG. 1 at least one clamp 40 is shown in its closed state, clamping down onto materials sheet 50. For the sake of clarity, FIG. 1 is not drawn to scale.

Push rod 90 is movably arranged on backbone 120 and latch 130 is rotatably arranged on backbone 120. Latch 130, having latch protrusion 160, can be rotated in direction 140 about latch rotation axis 150. Push rod 90 can be moved in direction 100 to press upon distal end 80. When push rod 90 pushes against clamp distal end 80, materials sheet 50 is no longer clamped by clamp 40 and can be removed.

Figure 2:
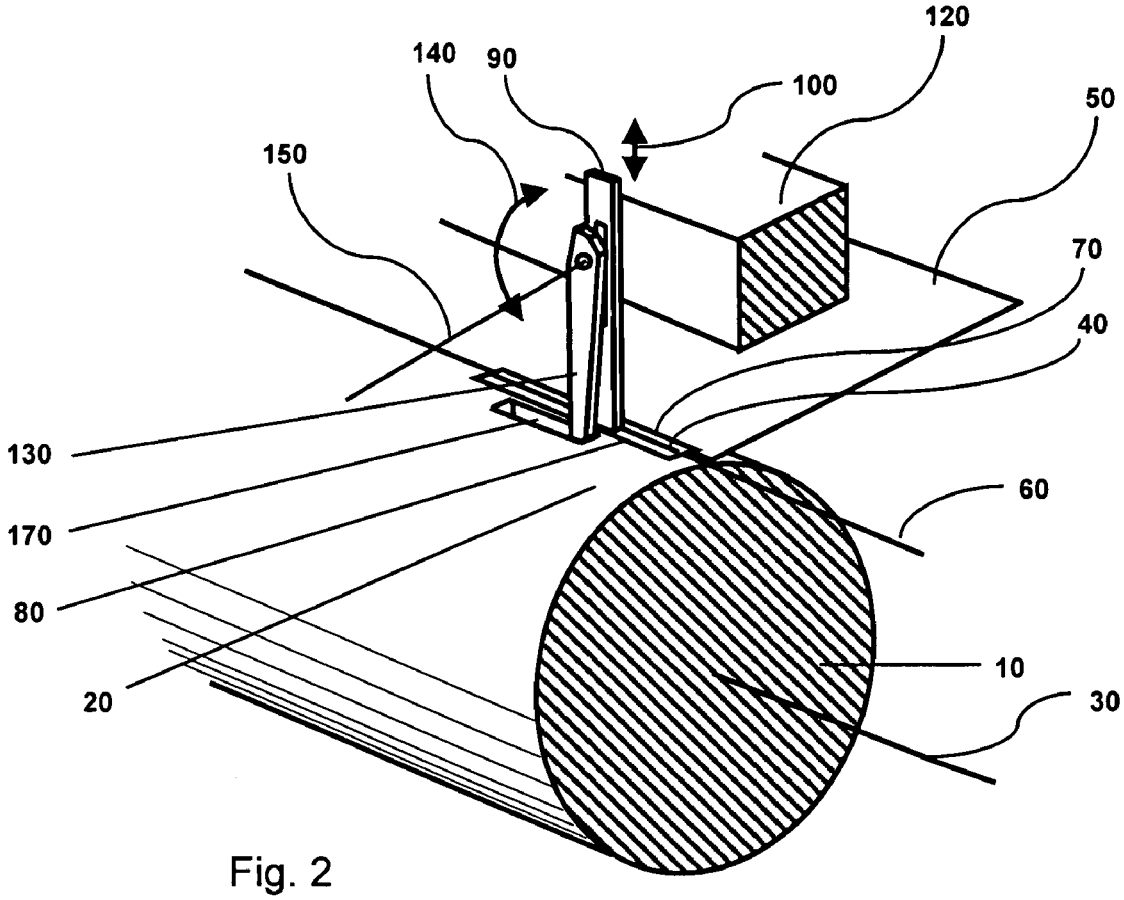
FIG. 2 shows a drum with an latch, slot, clamp and pushrod arrangement for clamping a materials sheet to the cylindrical surface of the drum, the arrangement being in the configuration where the materials sheet is released from the surface of the cylindrical surface of the drum.

FIG. 2 shows push rod 90 pressing upon distal end 80 of clamp 40 and latch 130 is rotated in direction 140 to mechanically engage drum 10 and removably attach backbone 120 to drum 10. For the sake of clarity, FIG. 2 is not drawn to scale.

Figure 3:
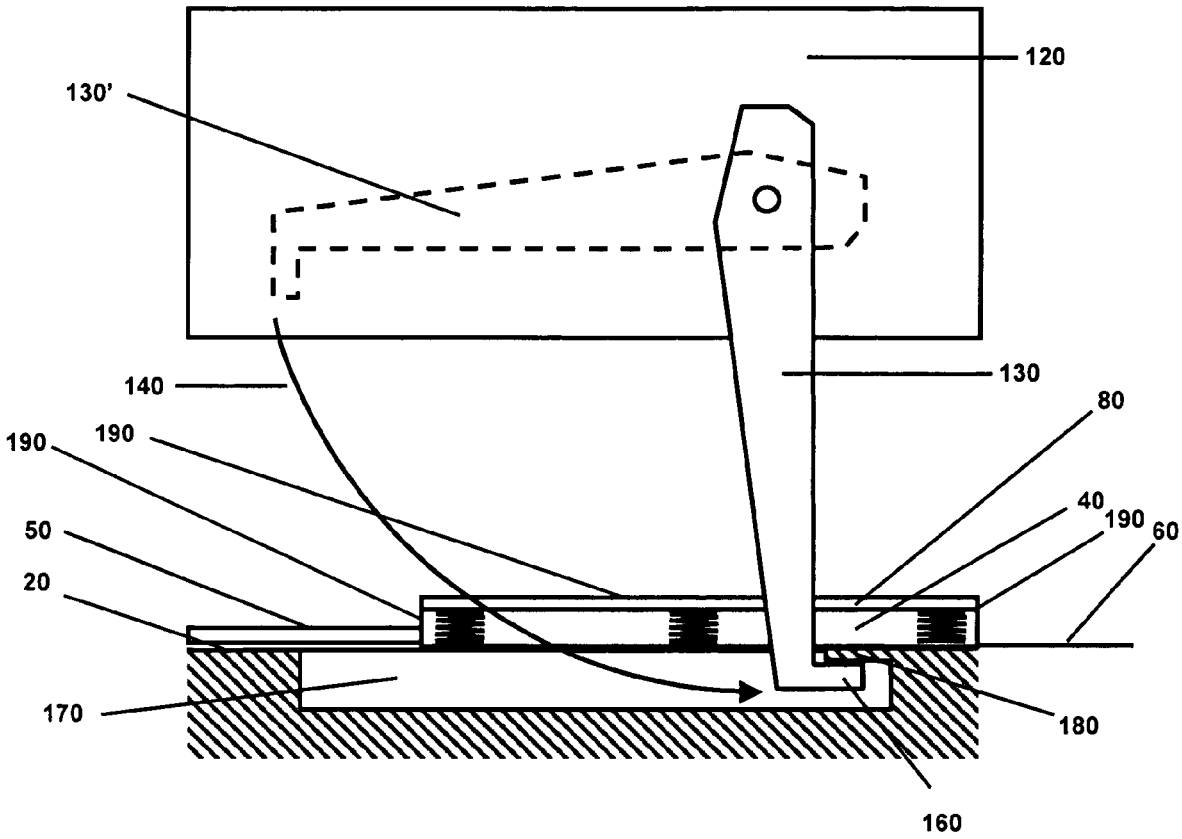
FIG. 3 shows the arrangement and working of the latch, slot and clamp of FIG. 1 and FIG. 2 in more detail.

FIG. 3, being a partial cutaway diagram of drum 10 in the vicinity of at least one clamp 40 and slot 170, shows a more detailed view of how latch protrusion 160 of latch 130 engages mechanically with slot ledge 180 of slot 170 of drum 10. For the sake of clarity, push rod 90 is not shown in FIG. 3. Latch is 130 shown in its disengaged position as 130' in dotted outline. Springs 190 provide the force to keep at least one clamp 40 in the closed position when distal end 80 is not pushed down by push rod 90.

Figure 4A:
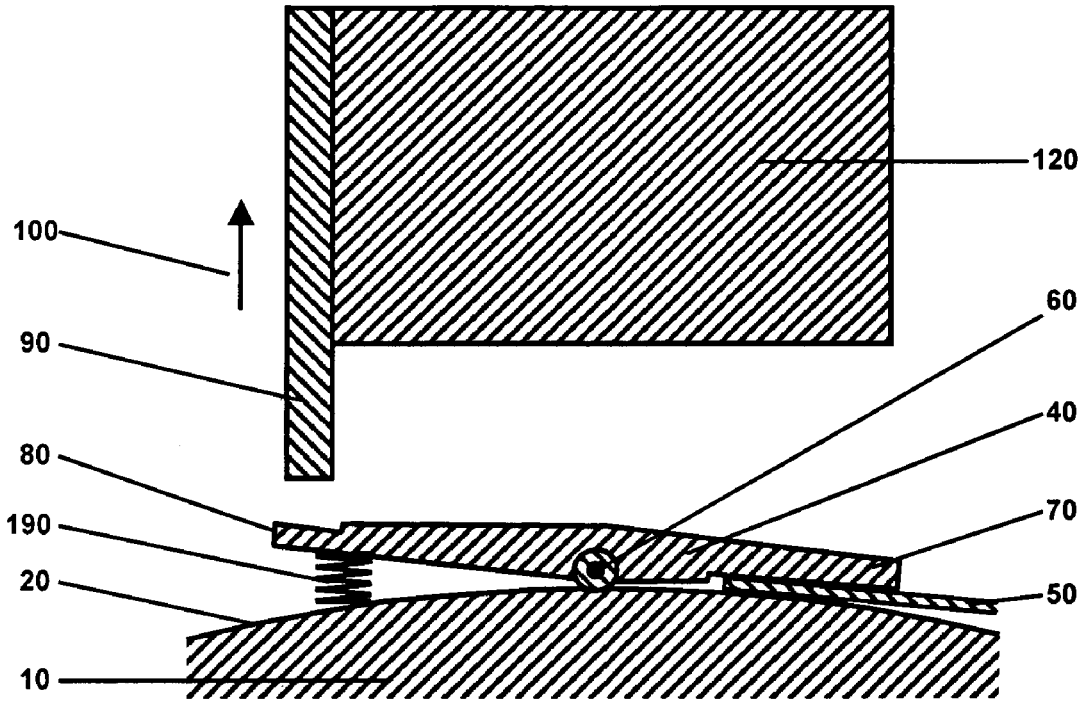
FIG. 4*a* shows the arrangement and working of the clamp and pushrod of FIG. 1 and FIG. 2 in more detail, with the clamp in the closed orientation.
Figure 4B:
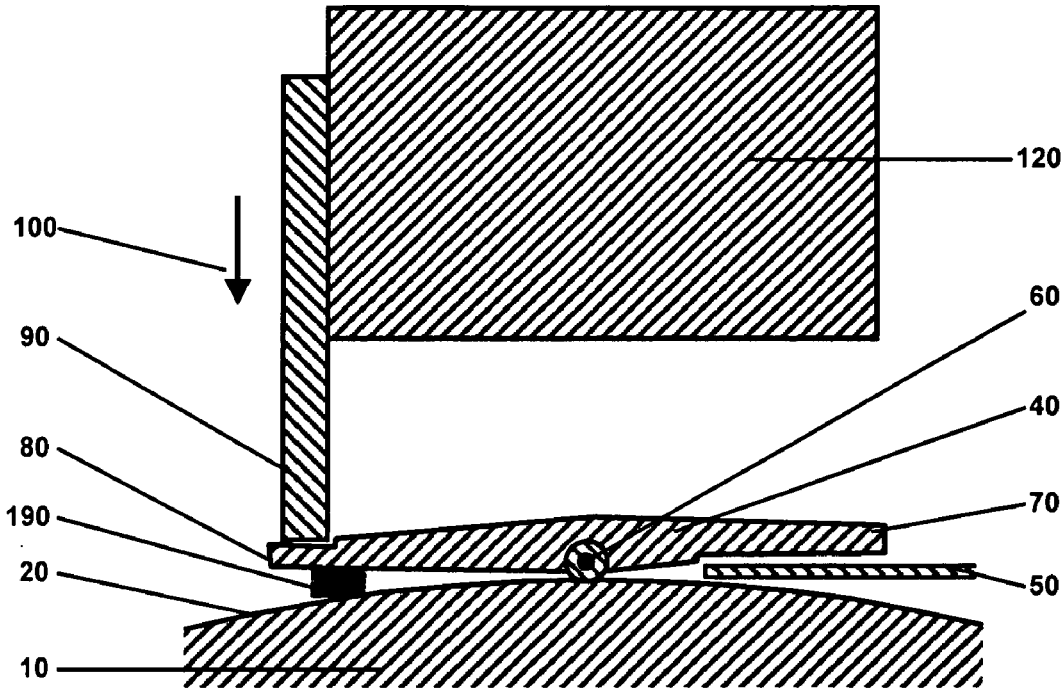
FIG. 4*b* shows the arrangement and working of the clamp and pushrod of FIG. 1 and FIG. 2 in more detail, with the clamp in the open orientation.

FIG. 4*a* and FIG. 4*b* show a more detailed view of the working of push rod 90 in opening and closing clamp 40. In FIG. 4*a* and FIG. 4*b* latch 130 and slot 70 are omitted for the sake of clarity. For the sake of clarity, FIG. 4*a* and FIG. 4*b* are not drawn to scale.

FIG. 4*a* shows clamp 40 in its closed position, clamping materials sheet 50 to cylindrical surface 20 of drum 10 by means of proximal end 70. Springs 190 provide the force on distal end 80 of clamp 40 to thereby close clamp 40 by pivoting it about pivot axis 60. Push rod 90 is in its retracted position on backbone 120, having been moved along direction 100.

FIG. 4*b* shows clamp 40 in its open position, releasing materials sheet 50 from cylindrical surface 20 of drum 10 by proximal end 70 being in a raised orientation. Springs 190 are compressed by the action of push rod 90 on backbone 120 pushing on distal end 80 of clamp 40 along direction 100. Clamp 40 is pivoted about pivot axis 60.

The apparatus of the present invention may have a plurality of clamps 40 and may have a plurality of push rods 90 and a plurality of latches 130, a plurality of sets of these devices being required to attach large materials sheets to extra large format drums, 3.15×1.6 meter plates having to be attached to drums of length greater than 3.15 meters in some cases. In a further embodiment of the present invention backbone 120 is capable of being relocated closer to or further away from cylindrical surface 20 of drum 10.

Figure 5:
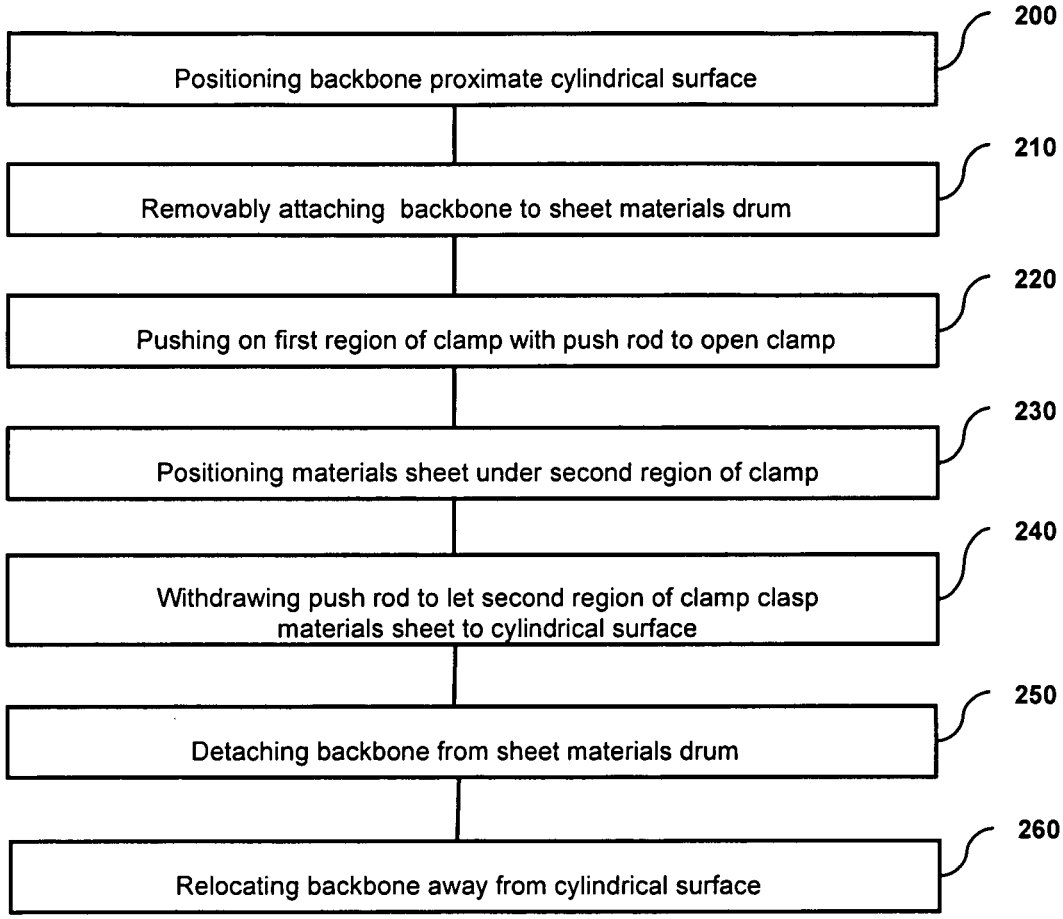
FIG. 5 is a flow diagram for a method to mount a materials sheet on a sheet materials drum.

In operation, as shown in the flow diagram of FIG. 5, the apparatus of the present invention provides a method for clasping a materials sheet 50 to a cylindrical surface 20 of a drum 10, the drum 10 comprising at least one clamp 40, the method comprising positioning (200) backbone 120 proximate cylindrical surface 20 of drum 10, removably attaching (210) onto drum 10 a backbone 120 comprising at least one push rod 90 movably arranged on backbone 120, pushing (220) on a first region of at least one clamp 40 with the push rod to open clamp 40, the first region in the case of the embodiment described here being distal end 80, positioning (230) the materials sheet under a second region of the clamp, the second region in the case of the embodiment described here being proximal end 70, withdrawing (240) the push rod 90 to let the second end of the clamp 40 clasp materials sheet 50 to the cylindrical surface 20, detaching (250) backbone 120 from sheet materials drum 10, and relocating (260) backbone 120 away from cylindrical surface 20.

Figure 6:
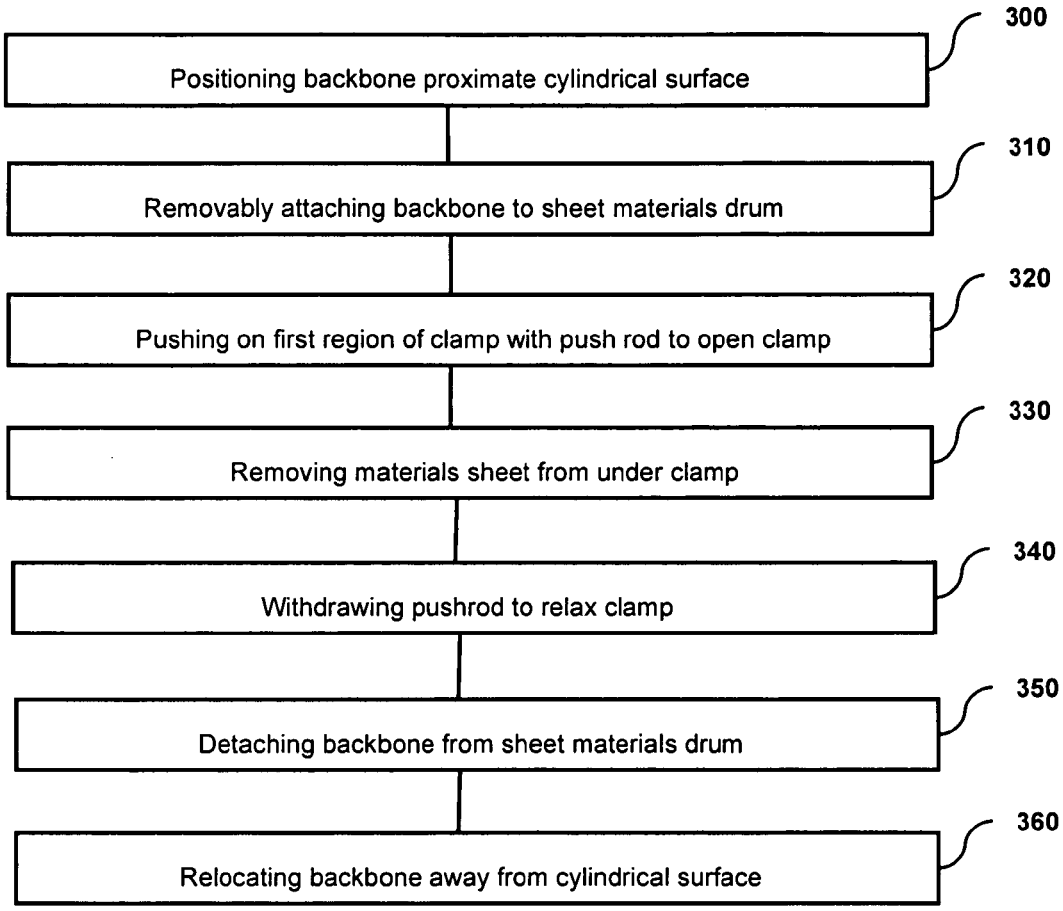
FIG. 6 is a flow diagram for a method to remove a materials sheet from a sheet materials drum.

In operation, as shown in the flow diagram of FIG. 6, the apparatus of the present invention furthermore provides a method for releasing a materials sheet 50 from a cylindrical surface 20 of a drum 10 to which it is clasped by at least one clamp 40, the method comprising positioning (300) backbone 120 proximate cylindrical surface 20 of drum 10, removably attaching (310) onto the drum 10 backbone 120 comprising at least one push rod 90 movably arranged on backbone 120, pushing (320) on a first region of at least one clamp 40 with the push rod 90 to open clamp 40, the first region in the case of the embodiment described here being distal end 80, removing (330) materials sheet 50 from under clamp 40, withdrawing (340) at least one pushrod 90 to cease pushing on the first region of at least one clamp 40 to thereby relax at least one clamp 40; detaching (350) backbone 120 from sheet materials drum 10, and relocating (360) backbone 120 away from cylindrical surface 20.

Figure 7:
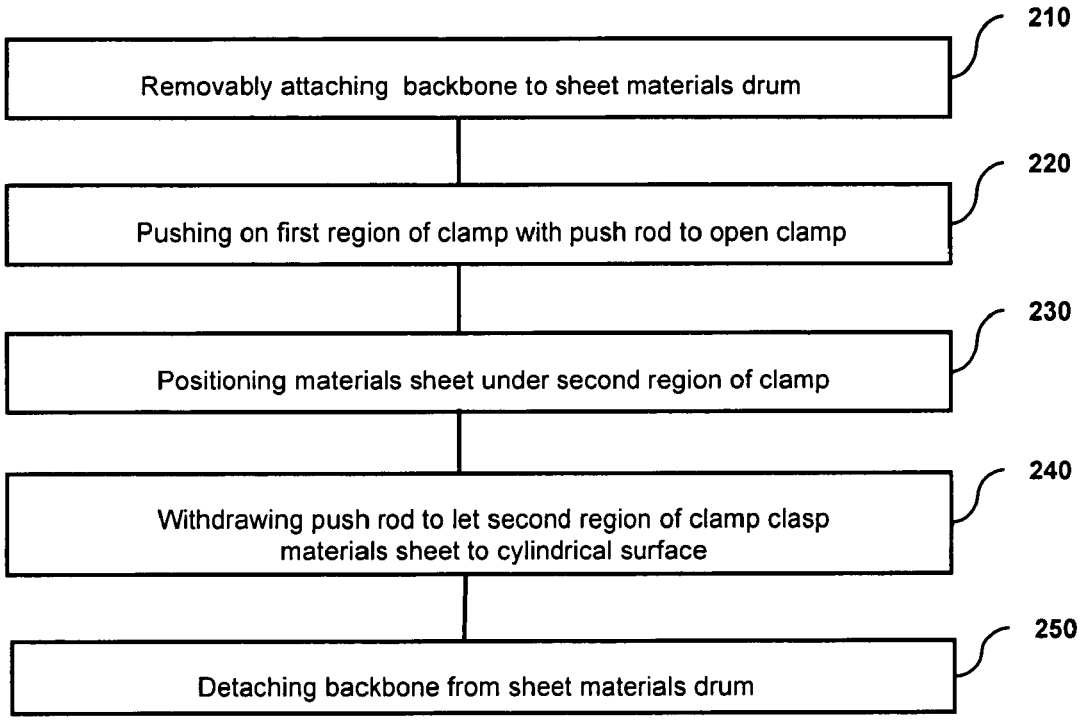
FIG. 7 is a flow diagram for a method for clasping materials sheet to a cylindrical surface of a drum.
Figure 8:
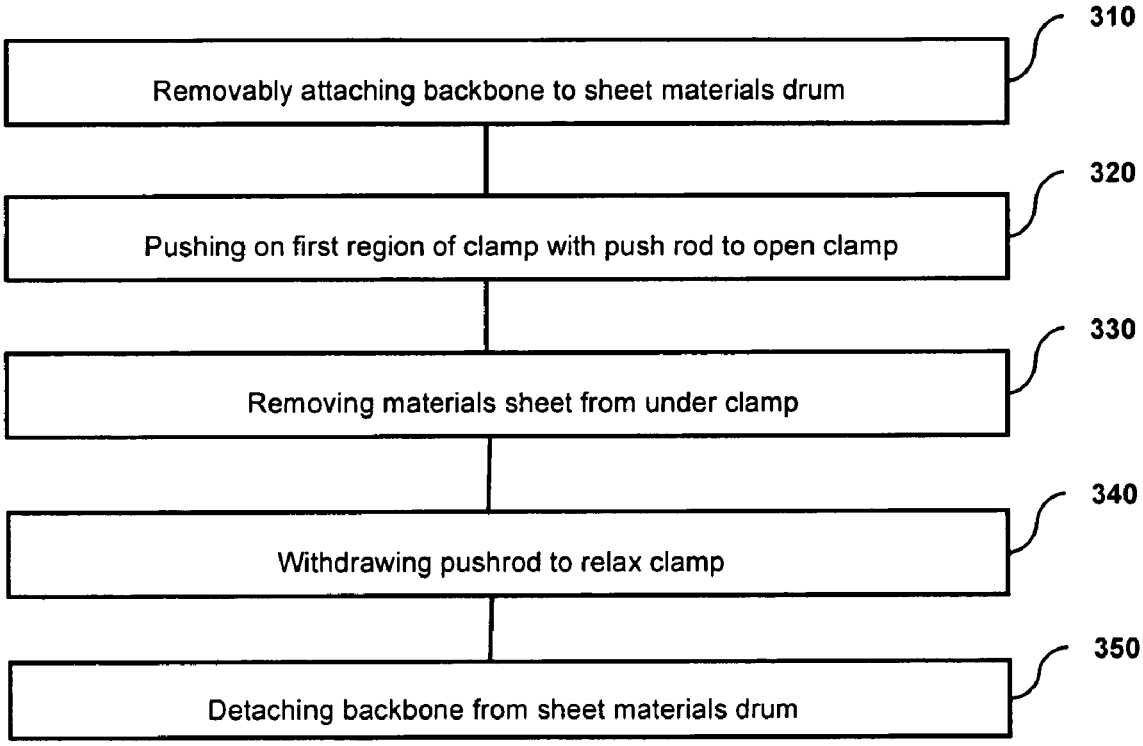
FIG. 8 is a flow diagram for a method for releasing materials sheet from a cylindrical surface of a drum.

In a further embodiment of the present invention, backbone 120 is maintained in a fixed position proximate cylindrical surface 20, but with suitable clearance for drum 10 and any clamps 40 to safely rotate past it. In this embodiment neither the method for clasping materials sheet 50 to cylindrical surface 20 of drum 10, as shown in the flow diagram of FIG. 7, nor the method for releasing materials sheet 50 from cylindrical surface 20 of drum 10, as shown in the flow diagram of FIG. 8, require backbone 120 to be re-positioned or relocated during execution of the respective methods.

In both the method of clasping and the method of releasing described herein backbone 120 may be removably attached onto drum 10 by a number of different alternative mechanisms, including but not limited to that of a latch 130 having a protrusion 160 that engages a ledge 180 of a slot 170 in drum 10.

Furthermore, slot 170 is not limited to being parallel to cylindrical axis 30 and may have any other orientation that allows a part of latch 130 to engage with it or any part of it, including but not limited to slot 170 being aligned perpendicular to cylindrical axis 30. Latch 130 can correspondingly be arranged on backbone 120 in any orientation that allows it to engage with slot 170 or any part of it.

The arrangement as described here prevents backbone 120 from flexing when a plurality of push rods push against a plurality of distal ends 80 of a plurality of clamps 40 arranged along the length of a long sheet materials drum 10. The invention thereby ensures smooth functioning of automated sheet materials loading and unloading operations.

The invention has been described in detail with particular reference to certain preferred embodiments thereof, but it will be understood that variations and modifications can be effected within the scope of the invention.

PARTS LIST

10 drum
20 cylindrical surface
30 cylindrical axis
40 clamp
50 materials sheet
60 pivot axis
70 proximal end of clamp 40
80 distal end of clamp 40
90 push rod
100 direction of motion of push rod
120 backbone
130 latch
130' disengaged latch position
140 direction of rotation of latch 130
150 latch rotation axis
160 latch protrusion
170 slot
180 slot ledge
190 springs
200 positioning backbone proximate cylindrical surface
210 removably attaching backbone onto sheet materials drum
220 pushing on first region of clamp with push rod to open clamp
230 positioning materials sheet under second region of clamp
240 withdrawing push rod to let second region of clamp clasp materials sheet to cylindrical surface
250 detaching backbone from sheet materials drum
260 relocating backbone away from cylindrical surface
300 positioning backbone proximate cylindrical surface
310 removably attaching backbone onto sheet materials drum
320 pushing on first region of clamp with push rod to open clamp
330 removing materials sheet from under clamp
340 withdrawing push rod to relax clamp
350 detaching backbone from sheet materials drum
360 relocating backbone away from cylindrical surface

The invention claimed is:

1. An apparatus comprising:

a) a sheet materials drum;

b) at least one clamp pivotably arranged on the sheet materials drum, the at least one clamp having a first region and a second region, the second region capable of clamping a materials sheet to the cylindrical surface of the sheet materials drum, a pivot axis of the at least one clamp being between the first region and the second region of the clamp;

c) a backbone extending along a length of the sheet materials drum, the backbone capable of being removably attached to the sheet materials drum; and d) at least one push rod movably arranged on the backbone, the at least one push rod arranged to be capable of pushing against the first region of the at least one clamp;

wherein the backbone comprises at least one latch arranged on the backbone, the latch capable of mechanically engaging the sheet materials drum to removably attach the backbone to the sheet materials drum.

2. The apparatus of claim 1, wherein the at least one latch is arranged to engage with a ledge of at least one slot in the sheet materials drum.

3. The apparatus of claim 1, wherein the at least one latch is arranged on the backbone in proximity to any one of the at least one push rod.

4. The apparatus of claim 1, wherein the at least one latch is rotatably arranged on the backbone.

* * * * *